US012403351B1

(12) United States Patent
Liu

(10) Patent No.: US 12,403,351 B1
(45) Date of Patent: Sep. 2, 2025

(54) ADJUSTABLE DUMBBELL

(71) Applicant: OHFG TECHNOLOGIES(SHANGHAI) CO., LTD, Shanghai (CN)

(72) Inventor: Ping Liu, Shanghai (CN)

(73) Assignee: OHFG TECHNOLOGIES(SHANGHAI) CO., LTD, Shanghai (CN)

( * ) Notice: Subject to any disclaimer, the term of this patent is extended or adjusted under 35 U.S.C. 154(b) by 60 days.

(21) Appl. No.: 18/603,680

(22) Filed: Mar. 13, 2024

(30) Foreign Application Priority Data

Feb. 28, 2024 (CN) ..... 202410224398.0

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01); *A63B 2209/08* (2013.01)

(58) Field of Classification Search
CPC ..... A63B 21/0726; A63B 21/0728; A63B 21/075; A63B 2209/08
See application file for complete search history.

(56) References Cited

U.S. PATENT DOCUMENTS

| | | | | |
|---|---|---|---|---|
| 5,637,064 | A * | 6/1997 | Olson | A63B 21/0728 482/107 |
| 6,083,144 | A | 7/2000 | Towley, III et al. | |
| 7,090,625 | B2 | 8/2006 | Chermack | |
| 8,394,004 | B2 * | 3/2013 | Towley, III | A63B 21/0726 482/107 |
| 9,795,822 | B2 * | 10/2017 | Smith | A63B 24/0087 |
| 10,166,431 | B2 | 1/2019 | Towley, III | |
| 10,518,123 | B2 * | 12/2019 | Moran | A63B 21/075 |
| 10,864,403 | B2 * | 12/2020 | Towley, III | A63B 21/0728 |
| 10,953,264 | B2 | 3/2021 | Towley, III | |
| 11,110,315 | B2 * | 9/2021 | Towley, III | B62J 9/26 |
| 11,452,902 | B2 * | 9/2022 | Moran | A63B 21/075 |
| 11,801,415 | B2 * | 10/2023 | Moran | A63B 21/0726 |
| 12,070,649 | B2 * | 8/2024 | Moran | A63B 21/0726 |
| 2012/0264575 | A1 * | 10/2012 | Towley, III | A63B 21/00065 482/107 |

* cited by examiner

*Primary Examiner* — Joshua Lee

(57) ABSTRACT

Provided is a novel adjustable dumbbell, including a handle and counter weights arranged on two sides of the handle, where each of the counter weights takes a dumbbell plate group as a weight core and is limited by a positioning frame; meanwhile, through cooperation of a positioning pin, a mounting hole in the positioning frame and a dumbbell plate unit re-positioning hole, the dumbbell plate unit can be increased/reduced through simple plugging and unplugging of the positioning pin, so that the weight of the dumbbell can be increased/reduced. The novel adjustable dumbbell is simple in structure and convenient to operate.

10 Claims, 6 Drawing Sheets

ADJUSTABLE DUMBBELL

CROSS REFERENCE TO RELATED APPLICATION

This application claims priority benefit of Chinese patent Application No. 202410224398.0, filed on Feb. 28, 2024, and the entire contents of which are incorporated herein by reference.

TECHNICAL FIELD

The present disclosure relates to the technical field of fitness equipment, and in particular to a novel adjustable dumbbell.

BACKGROUND

A dumbbell, as widely used fitness equipment, is mainly configured to enhance muscle strength training. An adjustable dumbbell is a dumbbell capable of adjusting the weight according to individual requirements.

The working principle of the adjustable dumbbell is to change the weight by adjusting internal locking mechanism, so that users can choose appropriate weight according to their own situation and training objectives. However, most of the adjustable dumbbells in the prior art are complicated in structure, so it is inconvenient to increase/reduce a dumbbell plate unit at any time; furthermore, during use, the dumbbell plate units at two ends of the dumbbell are prone to shake, so the safety is low.

Therefore, how to develop a novel adjustable dumbbell with a simple structure and capable of locking the position of a weight plate stably has become an urgent problem for people.

SUMMARY

In view of this, the present disclosure provides a novel adjustable dumbbell, so as to solve the problems that the adjustable dumbbell in the past has a complicated structure and is inconvenient to increase/reduce the weight, and a dumbbell plate unit is prone to shake.

The technical solution provided by the present disclosure is specially a novel adjustable dumbbell. The dumbbell includes: a handle and two counter weights;

the two counter weights are respectively arranged at two ends of the handle, and each of the counter weights includes: a dumbbell plate group, a positioning frame and a positioning pin;

the dumbbell plate group includes a plurality of dumbbell plate units which are clamped sequentially, and each of the dumbbell plate units is provided with a positioning hole penetrating through two sides;

the positioning frame is sleeved outside the dumbbell plate group and is fixedly connected to the handle, and the positioning frame is provided with a plurality of mounting holes corresponding to the dumbbell plate units in the dumbbell plate group at intervals; and the positioning pin is inserted in any one of the mounting holes in the positioning frame and the positioning hole in the corresponding dumbbell plate unit, and locks the corresponding dumbbell plate unit and all dumbbell plate units located on an inner side of the corresponding dumbbell plate unit in the positioning frame, or locks the corresponding dumbbell plate unit and all dumbbell plate units located on an outer side of the corresponding dumbbell plate unit in the positioning frame.

Preferably, one side of the dumbbell plate unit is provided with a sunken locking groove, the locking groove penetrates through a top end of the dumbbell plate unit, the other side of the dumbbell plate unit is correspondingly provided with a protruded locking block, and the locking block is in fit sliding clamping connection with the locking groove in the adjacent dumbbell plate unit.

Further preferably, one side of the dumbbell plate unit in the dumbbell plate group located on an end part of an outer side is provided with a sunken locking groove, and the other side is a plane.

Further preferably, an end face of the locking groove and an end face of the locking block are swallowtail-shaped.

Further preferably, the positioning frame includes: a first side plate, a second side plate and a connecting rod; and the first side plate and the second side plate are arranged at intervals and in parallel, the first side plate and the second side plate are fixedly connected to the connecting rod, the connecting rod is provided with the mounting holes at intervals, and the mounting holes are located between the first side plate and the second side plate.

Further preferably, the connecting rod in two positioning frames is one link rod, the handle is a hollow sleeve, and the handle is located between the two positioning frames and fixedly sleeved outside the connecting rod.

Further preferably, the center of each dumbbell plate unit is provided with a mounting hole channel penetrating through two sides in a longitudinal direction, and an upper end of the mounting hole channel penetrates through an upper end of the dumbbell plate unit.

Further preferably, the positioning pin includes: a plug-in bolt rod, a plug-in bolt cap and a magnet;

the plug-in bolt rod is U-shaped, one end is open, and the other end of the plug-in bolt rod is closed;

the plug-in bolt cap is buckled and sleeved at the closed end of the plug-in bolt rod, and an inner side of the plug-in bolt cap is provided with a mounting groove; and the magnet is mounted in the mounting groove of the plug-in bolt cap.

Further preferably, the adjustable dumbbell further includes: a base;

the base is configured to bear the handle and the counter weights at two ends, two ends of the base are bearing areas, limiting bosses are arranged on an upper surface of each of the bearing areas at intervals, and the limiting bosses correspond to the dumbbell plate units in the dumbbell plate group; and a bottom surface of each dumbbell plate unit is provided with a limiting groove matched with the limiting boss.

Further preferably, the base is provided with a plug-in bolt placing groove for placing the positioning pin.

The novel adjustable dumbbell provided by the present disclosure includes a handle and counter weights arranged on two sides of the handle, where each of the counter weights takes a dumbbell plate group as a weight core and is limited by a positioning frame, so that the problem that the dumbbell plate group is prone to shake can be effectively solved; meanwhile, through cooperation of a positioning pin, a mounting hole in the positioning frame and a dumbbell plate unit re-positioning hole, the dumbbell plate unit can be increased/reduced through simple plugging and unplugging of the positioning pin, so that the weight of the dumbbell can be increased/reduced. The novel adjustable dumbbell is simple in structure and convenient to operate.

BRIEF DESCRIPTION OF DRAWINGS

The drawings of the specification that constitute a part of the present application are used to provide a further understanding of the present disclosure. The exemplary embodiments of the present disclosure and the description thereof are used to explain the present disclosure, and do not constitute an improper limitation of the present disclosure. In the drawings.

DETAILED DESCRIPTION OF THE EMBODIMENTS

Figure 1:
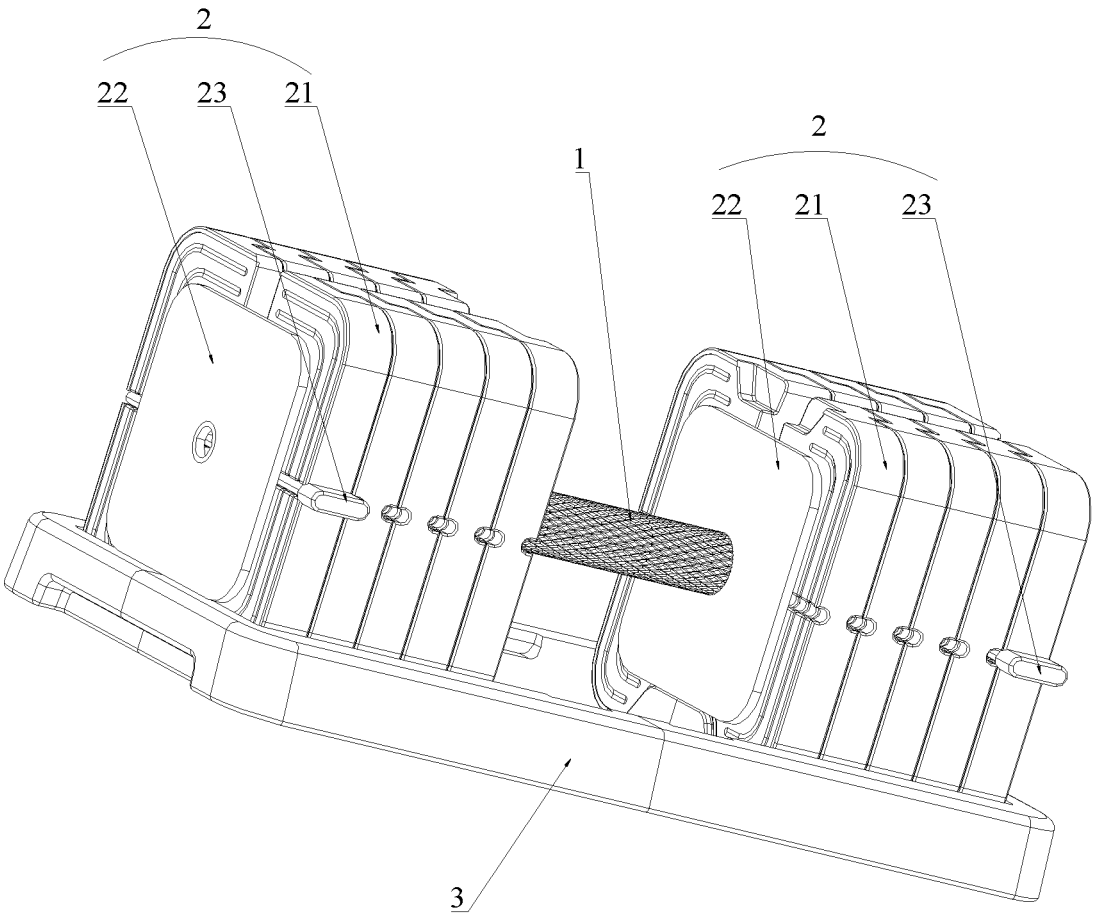
FIG. 1 is a structural schematic diagram of a novel adjustable dumbbell according to an embodiment of the present disclosure.

The present disclosure will be described in detail below with reference to the accompanying drawings and in conjunction with embodiments. Various examples are provided by way of interpretation of the present disclosure and are not intended to limit the present disclosure. Indeed, it will be apparent to those skilled in the art that modifications and variations may be made in the present disclosure without departing from the scope or spirit of the present disclosure. For example, features shown or described as part of one embodiment may be used in another embodiment to produce yet another embodiment. Therefore, it is desirable that the present disclosure includes such modifications and variations falling within the scope of the appended claims and their equivalents.

In the description of the present disclosure, the terms "longitudinal", "transverse", "up", "down", "front", "back", "left", "right", "vertical", "horizontal", "top", "bottom" and the like denote orientation or positional relationships based on those shown in the drawings and are intended for ease of description only and not to require that the present disclosure is necessarily constructed and operated in a particular orientation and thus cannot be construed as a limitation to the present disclosure. The terms "connection", "connect" and "set" used in the present disclosure should be understood in a broad sense, for example, which may refer to a fixed connection or a detachable connection; which may refer to a direct connection or an indirect connection through intermediate components; which may refer to a wired electrical connection, a radio connection, or a wireless communication signal connection, and the specific meanings of the above terms may be understood by those of ordinary skill in the art according to a specific situation.

One or more examples of the present disclosure are shown in the accompanying drawings. The detailed description uses numeric and letter marks to refer to features in the drawings. Similar or like reference signs in the drawings and descriptions have been used to refer to similar or like parts of the present disclosure. As used herein, the terms "first", "second", "third" and the like are used interchangeably to distinguish one member from another and are not intended to denote the location or importance of individual members.

To solve the problems that the adjustable dumbbell in the past has a complicated structure and is inconvenient to increase/reduce the weight, and a dumbbell plate unit is prone to shake, this embodiment provides a novel adjustable dumbbell. As shown in FIG. 1, the dumbbell mainly includes three parts, namely a handle 1 and two counter weights 2; the two counter weights 2 are respectively arranged at two ends of the handle 1 and fixedly connected to the handle 1; and the two counter weights 2 have the same structure and adjustable weight.

Figure 2:
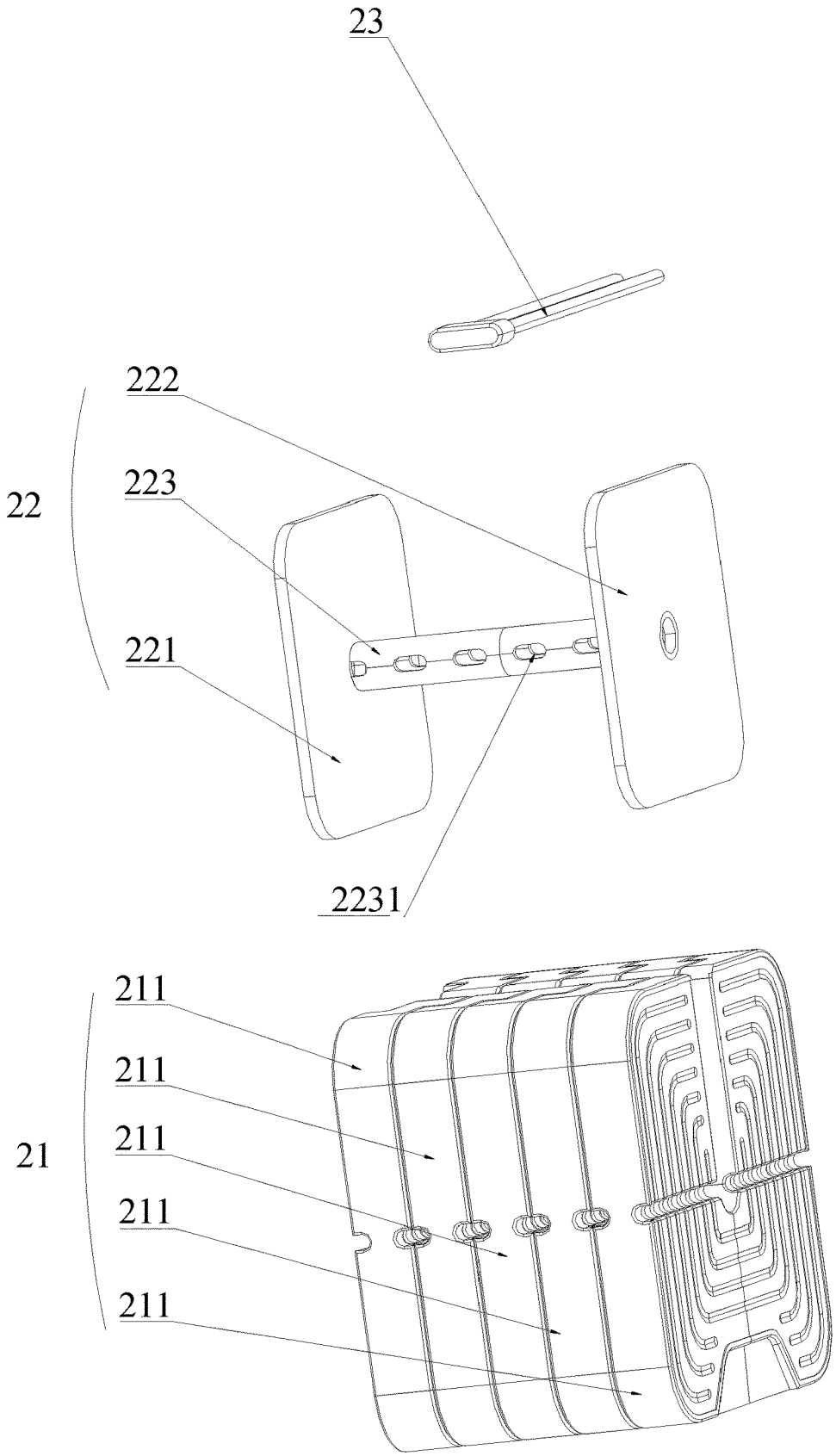
FIG. 2 is a structural schematic diagram of a counter weight in a novel adjustable dumbbell according to an embodiment of the present disclosure.

Referring to FIG. 2, each of the counter weights 2 includes three parts, namely a dumbbell plate group 21, a positioning frame 22 and a positioning pin 23, where the dumbbell plate group 21 takes the weight of the counter weights 2 as a core and includes a plurality of dumbbell plate units 211 which are clamped sequentially; each of the dumbbell plate units 211 is provided with a positioning hole 2113 penetrating through two sides; the positioning frame 22 is sleeved outside the dumbbell plate group 21; and the positioning frame 22 is provided with a plurality of mounting holes 2231 corresponding to the dumbbell plate units 211 in the dumbbell plate group 21 at intervals.

Figure 3:
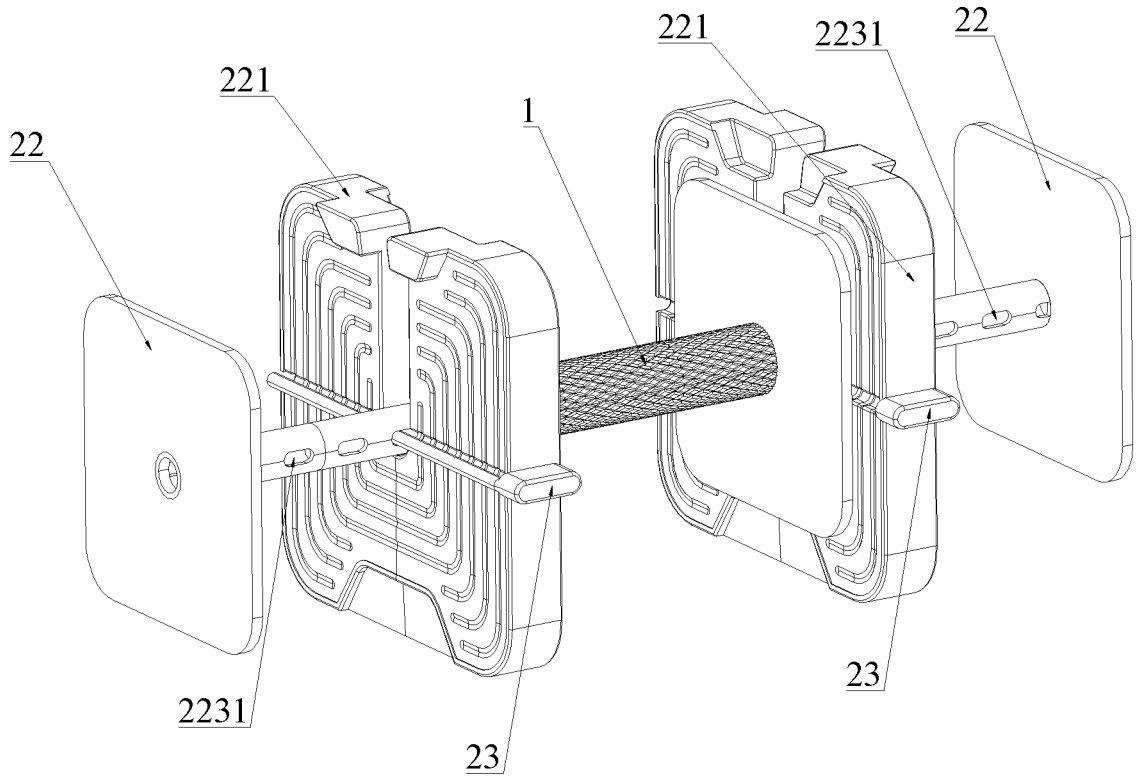
FIG. 3 is a schematic diagram of a novel adjustable dumbbell according to an embodiment of the present disclosure, in which a positioning pin is inserted into a first mounting hole on an inner side for taking.
Figure 4:
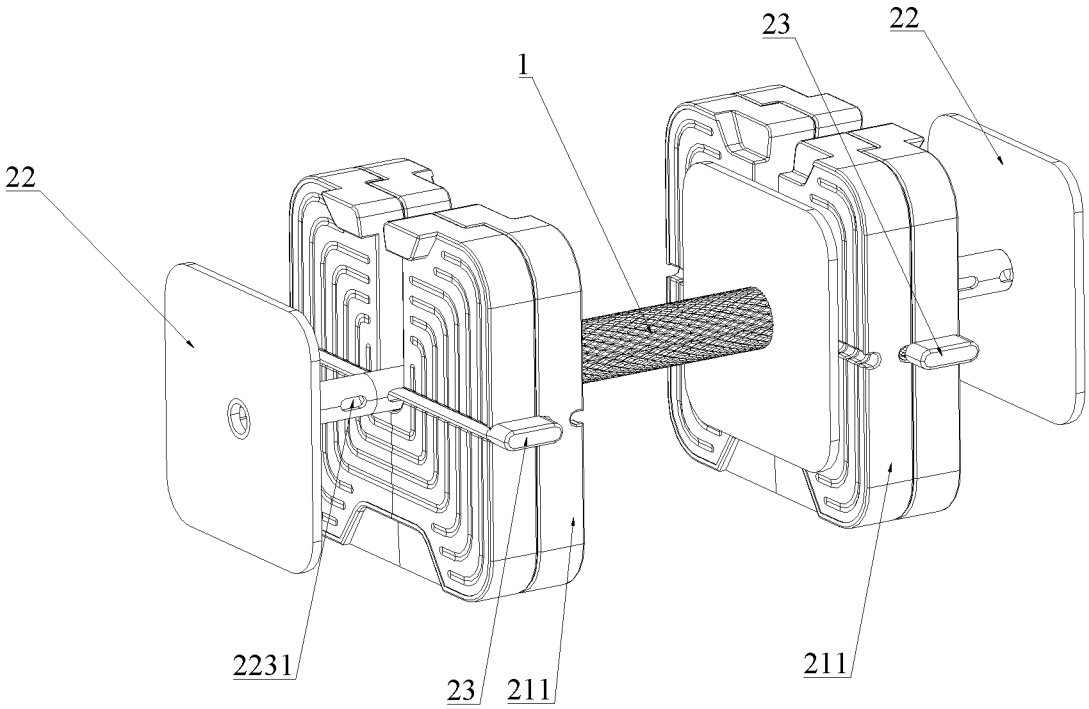
FIG. 4 is a schematic diagram of a novel adjustable dumbbell according to an embodiment of the present disclosure, in which a positioning pin is inserted into a second mounting hole on an inner side for taking.

The positioning pin 23 is inserted in any one or any one group of mounting holes 2231 in the positioning frame 22 and the positioning hole 2113 in the corresponding dumbbell plate unit 211, locks the corresponding dumbbell plate unit 211 and all dumbbell plate units 211 located on an inner side of the corresponding dumbbell plate unit 211 in the positioning frame 22; or locks the corresponding dumbbell plate unit 211 and all dumbbell plate units 211 located on an outer side of the corresponding dumbbell plate unit 211 in the positioning frame 22. At this time, when the handle of the dumbbell is held and is taken upwards, the dumbbell plate unit 211 locked in the positioning frame 22 can be taken together through the positioning pin 23, and the unlocked dumbbell plate unit 211 is placed at the original place. Therefore, by inserting the positioning pin 23 in different mounting holes 2231 in the positioning frame 22, the number of the taken dumbbell plate units 211 can be adjusted, the weight can be adjusted, and operation is simple. As shown in FIG. 3, when the positioning pin 23 is inserted in the first mounting hole 2231 in the inner side of the positioning frame 22, only one dumbbell plate unit 211 on the inner side of the dumbbell plate group 21 can be taken. As shown in FIG. 4, in a case that the positioning pin 23 is inserted into the second mounting hole 2231 in the inner side of the positioning frame 22, two dumbbell plate units 211 on the inner side of the dumbbell plate group 21 can be taken.

According to the novel adjustable dumbbell provided by the above embodiment, due to the brand new structural design of the structure of the counter weights 2, each dumbbell plate unit 211 is provided with the positioning hole 2113 which is matched with the mounting hole 2231 in the positioning frame 22; through the plugging and unplugging operation of the positioning pin 23, different numbers of dumbbell plate units 211 can be locked in the positioning frame 22, so that the locked number of the dumbbell plate units 211 can be adjusted, that is, when the weight of the counter weights 2 can be increased or reduced and the structure is simplified, the operation is facilitated. When the dumbbell is lifted, the dumbbell plate units 211 locked in the positioning frame 22 is limited by the positioning frame 22, so the shaking problem during lifting can be effectively solved, and the safety coefficient can be increased.

Figure 5:
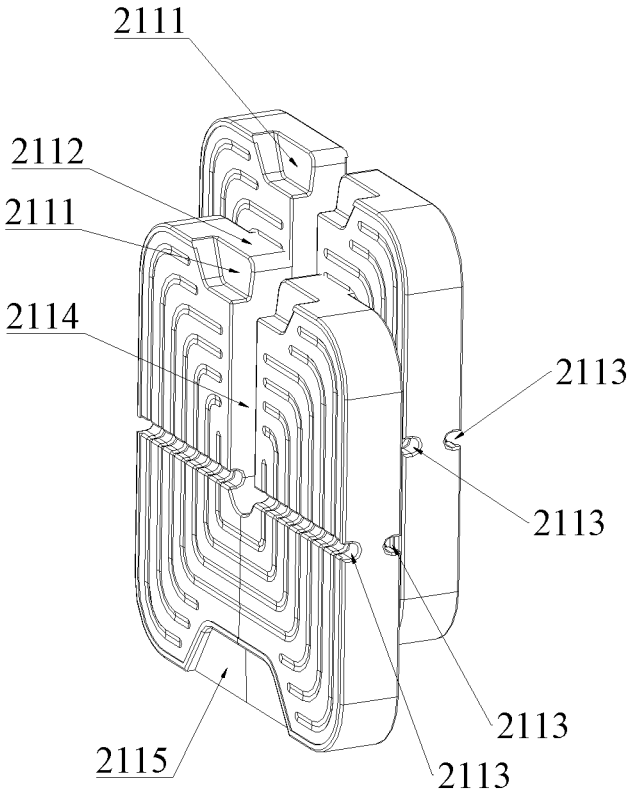
FIG. 5 is a structural schematic diagram of a dumbbell plate group in a novel adjustable dumbbell according to an embodiment of the present disclosure.

Referring to FIG. 5, this embodiment provides a specific structure of a dumbbell plate unit; one side of the dumbbell plate unit 211 is provided with a sunken locking groove 2111; the locking groove 2111 penetrates through the top end of the dumbbell plate unit 211; the other side of the dumbbell plate unit 211 is correspondingly provided with a protruded locking block 2112; and the locking block 2112 is in fit sliding clamping connection with the locking groove 2111 in the adjacent dumbbell plate unit 211.

Through the cooperation of the locking groove 2111 and the locking block 2112 between the dumbbell plate units, when the positioning pin 23 is inserted into the positioning hole 2113 of any dumbbell plate unit 211, the dumbbell plate units 211 of the locking groove 2111 of the dumbbell plate unit 211 are locked together through the cooperation between the locking block and the locking groove, the locking block of the dumbbell plate unit 211 slides out of the locking groove of the adjacent dumbbell plate unit 211, and the locking block and the locking groove are automatically unlocked.

The shape of the dumbbell plate unit 211 can be set freely according to preferences, for example, triangle and trapezoid. Taking the common square as an example in FIG. 5, the dumbbell plate unit 211 may be made of traditional high-density metal, or may be a structure of building a high-density filler in an injection molding shell. The structure of building the high-density filler in the injection molding shell can control the metal material within 15%, and 85% of the material can be replaced with a natural material and a degradable material, so that carbon can be greatly reduced, and the cost and selling price of products can also be reduced.

To make the dumbbell plate unit 211 and the positioning frame 22 fit better, as an improvement of the technical solution, referring to FIG. 1, one side of the dumbbell plate unit 211 of the dumbbell plate group 21 located on an end part of an outer side is provided with a sunken locking groove 2111, and the other side is a plane; at this time, the positioning pin 23 is inserted into the positioning hole 2113 of the dumbbell plate unit 211, and the dumbbell plate unit 211 and all dumbbell plate units 211 on the inner side can be locked; and in a case that one side of the dumbbell plate unit 211 of the dumbbell plate group 21 located on the end part of the inner side is provided with the sunken locking groove 2111, and the other side is a plane; and at this time, the positioning pin 23 is inserted into the positioning hole 2113 of the dumbbell plate unit 211, and the dumbbell plate unit 211 and all dumbbell plate units 211 on the outer side can be locked.

To improve the firmness of the clamping connection between the dumbbell plate units 211, as an improvement of the technical solution, the end face of the locking groove 2111 and the end face of the locking block 2112 are swallowtail-shaped.

Figure 6:
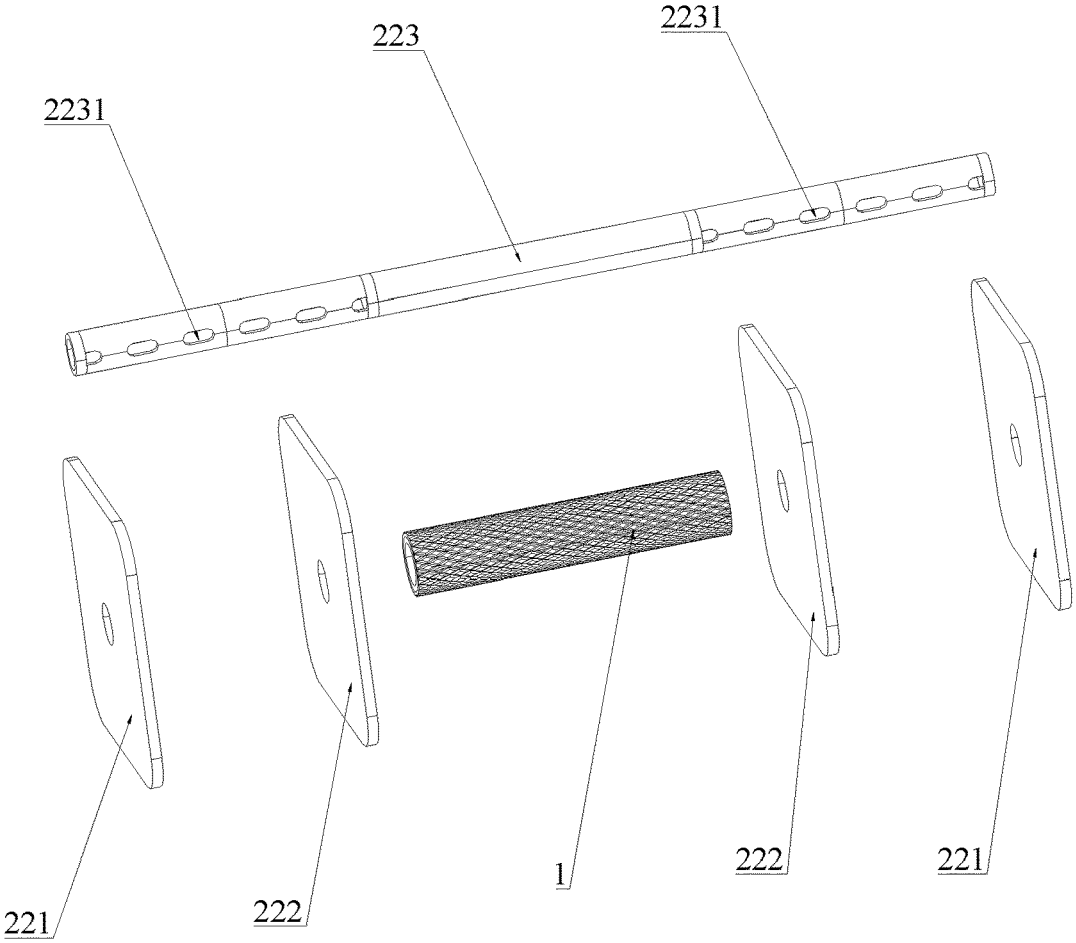
FIG. 6 is a structural schematic diagram of a positioning frame in a novel adjustable dumbbell according to an embodiment of the present disclosure.

Referring to FIG. 2, the positioning frame 22 mainly includes a first side plate 221, a second side plate 222 and a connecting rod 223, where the first side plate 221 and the second side plate 222 are arranged at intervals and in parallel; the first side plate 221 and the second side plate 222 are fixedly connected to the connecting rod 223; the connecting rod 223 is provided with mounting holes 2231 at intervals; and the mounting holes 2231 are located between the first side plate 221 and the second side plate 222. The connecting rod 223 in the positioning frames 22 at two ends of the handle may be two independent connecting rods, or may be one connecting rod. In a case that the connecting rod is the two independent connecting rods, two positioning frames 22 are connected by the handle 1 and are fixedly welded on the adjacent side plates in the two positioning frames 22 through the two ends of the handle; in a case that the connecting rod is one link rod, the two positioning frames 22 are connected by the connecting rod, the handle 1 is a hollow sleeve, the handle is located between the two positioning frames 22 and fixedly sleeved outside the connecting rod 223, and the specific structure is shown in FIG. 6; and when the two positioning frames 22 share one connecting rod, the mounting holes 2231 are formed at two ends of the connecting rod 223 at intervals.

To facilitate the mounting of each dumbbell plate unit, as an improvement of the technical solution, referring to FIG. 5, the center of each dumbbell plate unit 211 is provided with a mounting hole channel 2114 penetrating through two sides in a longitudinal direction; an upper end of the mounting hole channel 2114 penetrates through an upper end of the dumbbell plate unit 211; and the mounting hole channel 2114 is mainly used for the connecting rod 223 in the positioning frames 22 to pass through.

Figure 7:
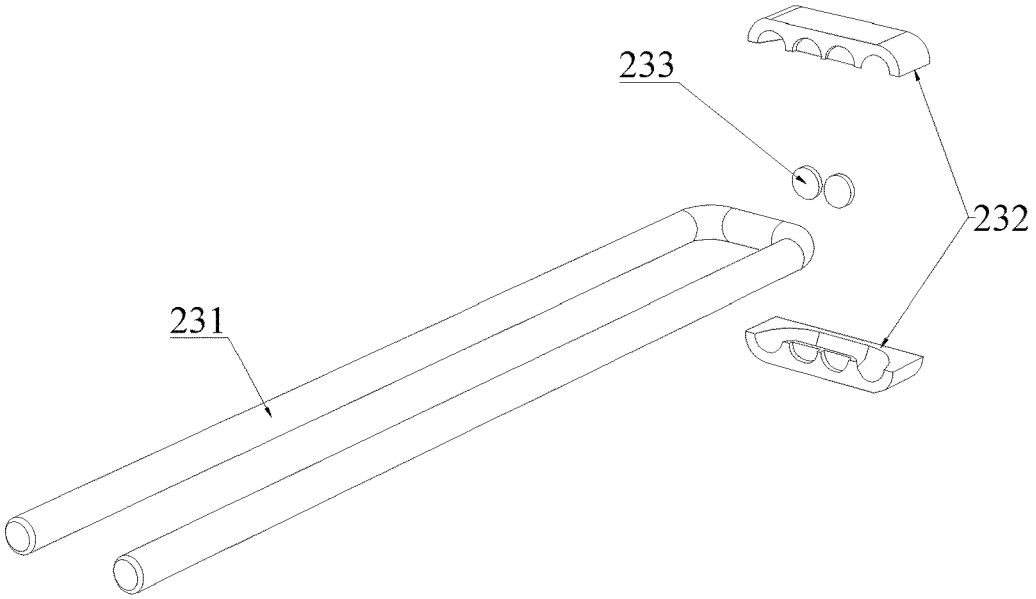
FIG. 7 is a structural schematic diagram of a positioning pin in a novel adjustable dumbbell according to an embodiment of the present disclosure.

Referring to FIG. 7, the positioning pin 23 mainly includes a plug-in bolt rod 231, a plug-in bolt cap 232 and a magnet 233, where the plug-in bolt rod 231 is U-shaped, one end is open, and the other end is closed; the plug-in bolt cap 232 includes an upper part and a lower part which are buckled and sleeved at the closed end of the plug-in bolt rod 231; an inner side of the plug-in bolt cap 232 is provided with a mounting groove 2321; the magnet 233 is mounted in the mounting groove 2321 of the plug-in bolt cap 232; after the positioning pin 23 is inserted into the mounting hole 2231 in the positioning frame 22 and the positioning hole in the dumbbell plate unit, a force for promoting the positioning pin 23 to be inserted inward can be generated by a magnetic attraction force of the magnet, so that operation is facilitated; meanwhile, after mounting in place, the magnet is tightly attracted to the dumbbell plate unit, thereby avoiding accidental falling and further improving the safety.

The plug-in bolt rod 231 may adopt a U shape in FIG. 7, or may adopt a traditional straight line. The main objective of using the U shape is to improve the stability. The U-shaped plug-in bolt rod is equivalent to using two spaced points to limit the dumbbell plate unit to avoid shaking.

In cooperation with the use of the U-shaped plug-in bolt rod 231, each dumbbell plate unit 211 is provided with two positioning holes 2113 at intervals; the positioning holes may be formed in the dumbbell plate unit 211 to penetrate through two sides; however, for the processing convenience, preferably, as shown in FIG. 5, two side surfaces of the dumbbell plate unit 211 are provided with sunken arc-shaped grooves as two spaced positioning holes.

Figure 8:
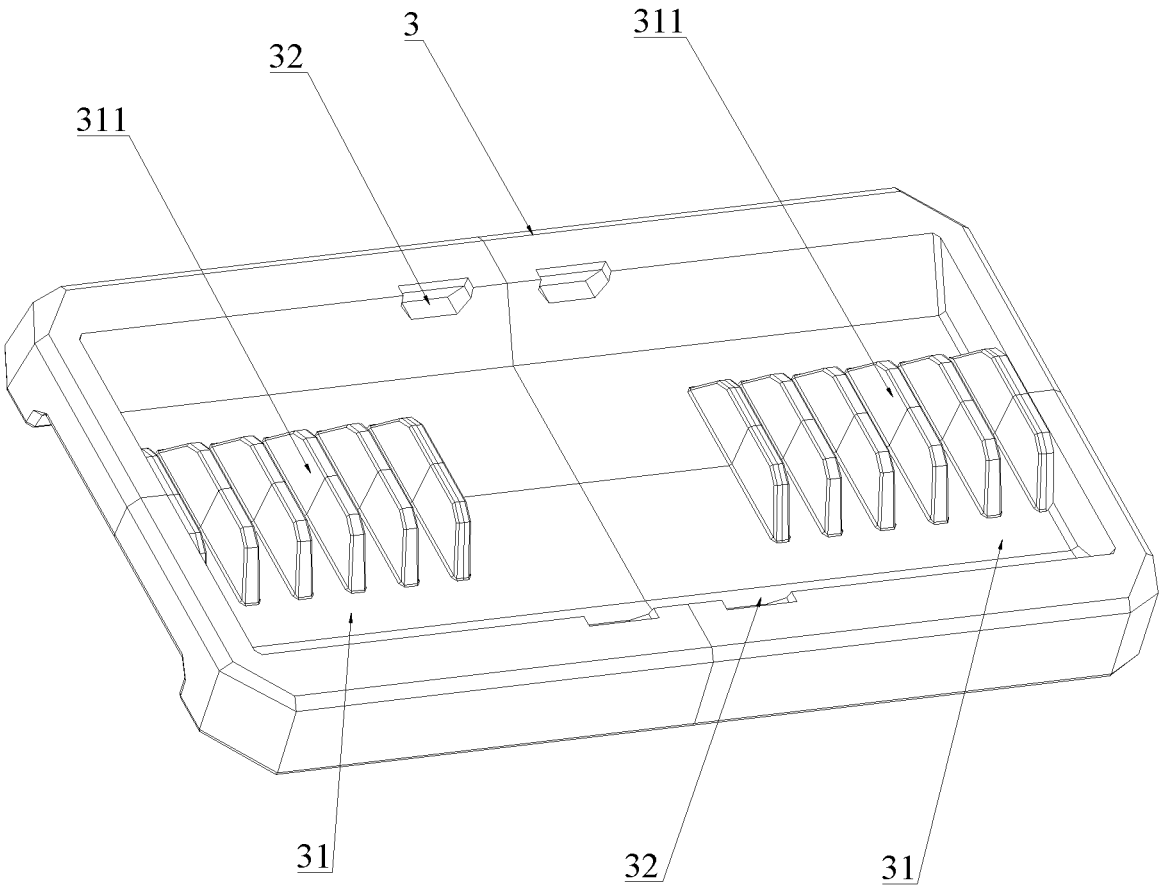
FIG. 8 is a structural schematic diagram of a base in a novel adjustable dumbbell according to an embodiment of the present disclosure.

Referring to FIG. 8, the adjustable dumbbell further includes: a base 3; referring to FIG. 1, the base 3 is configured to bear the handle 1 and the counter weights 2 at two ends; two ends of the base 3 are bearing areas 31; an upper surface of each of the bearing areas is provided with limiting bosses 311 at intervals; the limiting bosses 3113 correspond to the dumbbell plate units 211 in the dumbbell plate group 21; and referring to FIG. 5, a bottom surface of each dumbbell plate unit 211 is provided with a limiting groove 2115 matched with the limiting boss 311. When the dumbbell plate group 21 is placed on the base 3, the limiting groove 2115 on the bottom surface of each dumbbell plate unit 211 cooperates with the corresponding limiting boss 311 to limit each dumbbell plate unit 211.

Preferably, the base 3 is provided with a plug-in bolt placing groove 32 for placing the positioning pin 23.

To further improve the safety, a surface of the handle 1 of the dumbbell is provided with skidproof stripes.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. A novel adjustable dumbbell, comprising a handle and two counter weights, wherein the two counter weights are respectively arranged at two ends of the handle, and each of the counter weights comprises: a dumbbell plate group, a positioning frame and a positioning pin;

wherein the dumbbell plate group comprises a plurality of dumbbell plate units which are clamped sequentially, and each of the dumbbell plate units is provided with a positioning hole penetrating through two sides;

wherein the positioning frame is sleeved outside the dumbbell plate group and is fixedly connected to the handle, and the positioning frame is provided with a plurality of mounting holes corresponding to the dumbbell plate units in the dumbbell plate group at intervals; and wherein the positioning pin is inserted in any one of the mounting holes in the positioning frame and the positioning hole in the corresponding dumbbell plate unit, and locks the corresponding dumbbell plate unit and all dumbbell plate units located on an inner side of the corresponding dumbbell plate unit in the positioning frame, or locks the corresponding dumbbell plate unit and all dumbbell plate units located on an outer side of the corresponding dumbbell plate unit in the positioning frame.

2. The novel adjustable dumbbell according to claim 1, wherein one side of each dumbbell plate unit is provided with a sunken locking groove, the locking groove penetrates through a top end of the dumbbell plate unit, the other side of the dumbbell plate unit is correspondingly provided with a protruded locking block, and the locking block is in fit sliding clamping connection with the locking groove in an adjacent dumbbell plate unit.

3. The novel adjustable dumbbell according to claim 2, wherein one side of a dumbbell plate unit in the dumbbell plate group located on an end part of an outer side is provided with a sunken locking groove, and the other side is a plane.

4. The novel adjustable dumbbell according to claim 2, wherein an end face of the locking groove and an end face of the locking block are swallowtail-shaped.

5. The novel adjustable dumbbell according to claim 1, wherein the positioning frame comprises: a first side plate, a second side plate and a connecting rod; and wherein the first side plate and the second side plate are arranged at intervals and in parallel, the first side plate and the second side plate are fixedly connected to the connecting rod, the connecting rod is provided with the mounting holes at intervals, and the mounting holes are located between the first side plate and the second side plate.

6. The novel adjustable dumbbell according to claim 5, wherein the connecting rod is one link rod, the handle is a hollow sleeve, and the handle is arranged between two positioning frames and fixedly sleeved outside the connecting rod.

7. The novel adjustable dumbbell according to claim 6, wherein a center of each dumbbell plate unit is provided with a mounting hole channel penetrating through two sides in a longitudinal direction, and an upper end of the mounting hole channel penetrates through an upper end of the dumbbell plate unit.

8. The novel adjustable dumbbell according to claim 1, wherein the positioning pin comprises: a plug-in bolt rod, a plug-in bolt cap and a magnet;

wherein the plug-in bolt rod is U-shaped, one end is open, and the other end of the plug-in bolt rod is closed;

wherein the plug-in bolt cap is buckled and sleeved at the closed end of the plug-in bolt rod, and an inner side of the plug-in bolt cap is provided with a mounting groove; and wherein the magnet is mounted in the mounting groove of the plug-in bolt cap.

9. The novel adjustable dumbbell according to claim 1, further comprising: a base, wherein the base is configured to bear the handle and the counter weights at two ends, two ends of the base are bearing areas, limiting bosses are arranged on an upper surface of each of the bearing areas at intervals, and the limiting bosses correspond to the dumbbell plate units in the dumbbell plate group; and wherein a bottom surface of each dumbbell plate unit is provided with a limiting groove matched with the limiting boss.

10. The novel adjustable dumbbell according to claim 9, wherein the base is provided with a plug-in bolt placing groove for placing the positioning pin.

* * * * *